United States Patent [19]

Asada

[11] 4,051,074

[45] Sept. 27, 1977

[54] RESISTOR COMPOSITION AND METHOD FOR ITS MANUFACTURE

[75] Inventor: Eiichi Asada, Tokyo, Japan

[73] Assignee: Shoei Kagaku Kogyo Kabushiki Kaisha, Tokyo, Japan

[21] Appl. No.: 626,773

[22] Filed: Oct. 29, 1975

[51] Int. Cl.[2] ..... H01B 1/02

[52] U.S. Cl. ..... 252/503; 252/506; 252/512; 252/514; 252/515; 252/518

[58] Field of Search ..... 252/514, 518, 512, 515, 252/506, 503; 106/53, 54

[56] References Cited

U.S. PATENT DOCUMENTS 3,865,742 2/1975 Greenstein ..... 252/514

*Primary Examiner*—Benjamin R. Padgett

*Assistant Examiner*—Deborah L. Kyle

*Attorney, Agent, or Firm*—Birch, Stewart, Kolasch and Birch

[57] ABSTRACT

A resistor composition and process for making the same which comprises a conductive material, a glass frit and a vehicle therefor or a conductive material, a glass frit, an insulating or semiconductive metal oxide and a vehicle therefor, the weight ratio of said conductive material, said glass frit and said metal oxide, when the latter is present, being maintained substantially constant, wherein the resistance value of said composition is established by varying the total surface area of said conductive material, and said glass frit and, when applicable, said metal oxide, without changing the temperature coefficient of resistance of said composition.

9 Claims, No Drawings

RESISTOR COMPOSITION AND METHOD FOR ITS MANUFACTURE

BACKGROUND AND SUMMARY OF THE INVENTION:

The present invention relates to a novel resistor composition having an excellent temperature coefficient of resistance (TCR) and its method of preparation. More particularly, the present invention is directed to a resistor composition containing a conductive material and a glass frit or a conductive material, a glass frit and an insulating or semiconductive metal oxide wherein the weight ratio of said conductive material and said glass frit or said conductive material, said glass frit and said metal oxide is maintained constant and the resistance value of the resistor composition is determined by varying the total surface area of said conductive material and said glass frit or by varying the total surface area of said conductive material, said glass frit and said metal oxide without substantially changing the temperature coefficient of resistance of the resistor composition.

In the previous, well-known techniques, the preparation of a resistor composition containing a series of varied resistance values was obtained by controlling the weight ratio of the components of the resistor composition, that is, the weight ratio of the conductive material and the resistive material. However, in following the well-known techniques for the preparation of resistor compositions, the variation of the resistance value was always accompanied by a simultaneous deviation in the temperature coefficient of resistance. Therefore, in the prior art resistor compositions and method of manufacture, it was impossible to obtain certain definite resistance values without varying the temperature coefficient of resistance.

In addition, although an even surface film resistor with higher resistance value is obtainable, adoption of some special devices are inevitably required in the preparation processes of the resistor composition. With respect to resistors having a lower resistance value, although compositions having satisfactory printing ability are obtainable, the yielded resistors normally have uneven surfaces and also unstable resistance values.

The present invention is directed to a resistor composition comprising a conductive material and a glass frit, or a conductive material, a glass frit and an insulating or semiconductive metal oxide, wherein the weight ratio of the conductive material and the glass frit and, when present, the said metal oxide is constant and the resistance value of the composition is determined by varying the total surface area of the conductive material, the glass frit and, when present, the said metal oxide, without changing the temperature coefficient of resistance of the composition. In the process for manufacturing the resistor composition of the present invention, conductive materials, glass frit and insulating or semiconductive metal oxides having known specific areas are utilized and the resistance value of the resistor composition is determined by increasing or decreasing the total surface area of said conductive material, said glass frit and, when present, said metal oxide, while maintaining the weight ratio of said conductive material, glass frit and said metal oxide constant. Alternatively, the specific surface area of one or two components selected from the above two or three components can be either increased or decreased while maintaining the specific surface area of the residual component constant and while maintaining the weight ratio of said two components or said three components constant. Advantageously, a vehicle is provided for said two-component or three-component resistor composition of the present invention.

Thus, according to the present invention, the problems encountered in the prior art resistor compositions and processes have been overcome by the teachings of the present invention which are summarized as follows:

1. A resistor composition comprising a conductive material, a glass frit and a vehicle therefor wherein the weight ratio of said conductive material to said glass frit is constant and the resistance value of said composition is established by varying the total surface area of said conductive material and said glass frit without changing the TCR of said composition.

2. A resistor composition comprising a conductive material, a glass frit, an insulating or semiconductive metal oxide and a vehicle therefor, wherein the weight ratio of said conductive material, said glass frit, and said insulating or semiconductive metal oxide is constant and the resistance value of said composition is established by varying the total surface area of said conductive material, said glass frit and said insulating or semiconductive metal oxide without changing the TCR of said composition.

3. A process for manufacturing a resistor composition characterized by using a conductive material and a glass frit having known specific surface areas, respectively, and establishing the resistance value of said resistor composition by increasing or decreasing the total surface area of said conductive material and said glass frit while maintaining the weight ratio of said conductive material to said glass frit constant.

4. A process for manufacturing a resistor composition characterized by using a conductive material, a glass frit and an insulating or semiconductive metal oxide having known specific surface areas, respectively, and establishing the resistor value of said resistor composition by increasing or decreasing the total surface area of said conductive material, glass frit and insulating or semiconductive metal oxide while keeping the weight ratio of said conductive material, glass frit and insulating or semiconductive metal oxide constant.

5. A process for manufacturing a resistor composition characterized by using a conductive material and a glass frit having known specific areas, respectively, and establishing the resistance value of said resistor composition by increasing or decreasing the specific surface area of one component and maintaining the specific surface area of the other component constant while keeping the weight ratio of said conductive material to said glass frit constant.

6. A process for manufacturing a resistor composition characterized by using a conductive material, a glass frit and an insulating or semiconductive metal oxide having known specific surface areas, respectively, and establishing the resistance value of said resistor composition by increasing or decreasing the specific surface area of one or two components and maintaining the specific surface area of the residual component or components constant while keeping the weight ratio of said conductive material, glass frit and insulating or semiconductive metal oxide constant.

As mentioned above, one of the main features of the present invention is that a definite resistance value is easily obtained by controlling the total surface area while the temperature coefficient of resistance is maintained substantially constant. However, the theoretical reasons why this phenomena exists is uncertain. One possible assumption in this connection is an explanation based upon the contact area between the resistive material and the conductive material. But the effects cannot be fully understood from only the above assumption. In any event, the amount of reproducibility involved in the present invention suggests that this is an entirely novel and widely applicable technical contribution which has not yet been fully supported by theoretical bases.

The term "specific surface area" as referred to hereinabove shall be defined as the surface area of each 1 gram of finely divided particles, and accordingly, the "total surface area" can be defined by the following equation:

Total surface area = specific surface area × total wt. of particles

The conductive material or component which can be utilized in the present invention can be, for example, Au (gold), Ag (silver), Pt (platinum), Rh (rhodium), Ru (ruthenium), Os (osmium), Ir (iridium), V (vanadium), Sn (tin), W (tungsten), C (carbon), and alloys, mixtures, and oxides thereof. These conductive materials, after the composition has been fired, become highly conductive particles.

The glass frits which can be used in the resistor composition of the present invention are, generally speaking, conventional glass frits. Examples of such glass frits include the borosilicates and particularly the lead-borosilicates.

The insulating or semiconductive metal oxide which can be used in the resistor composition of the present invention should be capable of producing, after firing, finely divided particles with insulating or semiconductive properties. Exemplary of suitable insulating or semiconductive metal oxides include palladium oxide, copper oxide, aluminum oxide, zinc oxide, iron oxide, chromium oxide, cobalt oxide, tantalum oxide, nickel oxide, niobium oxide, silicon oxide and the like. The finely divided particles of the said conductive material, glass frit and metal oxide are those containing a diameter of about 100 A to 50 $\mu$.

The vehicle which can be used in combination with the conductive material, glass frit and the insulating or semiconductive metal oxide in forming the resistor composition of the present invention can be an organic binder, such as, for example, ethyl cellulose, alkyd resins, butyral resins, nitrocellulose, and the like. Any vehicles which are normally used in the resistor field of technology are applicable to the resistor composition and method of the present invention.

Examples of suitable solvents which can be included in the resistor composition of the present invention include organic solvents such as butyl carbitol, butyl carbitol acetate, terpineol, tetralin, and the like.

In the resistor composition of the present invention, the conductive material can be present in an amount of about 10 to 60 parts by weight and the resistive material, which includes the glass frit alone or the glass frit and the insulating or semiconductive metal oxide can be present in an amount of about 40 to 90 parts by weight.

The specific surface area of the conductive material, glass frit and insulating or semiconductive metal oxide can be varied from 0.02 to about 270 $m^2/g$. Within this range, the specific surface area of the conductive material can vary from about 0.02 to about 85; the specific surface area of the glass frit can vary from about 0.05 to 2.0, and the specific surface area of the insulating or semiconductive metal oxide can vary from about 0.5 to 265.

DESCRIPTION OF THE PREFERRED EMBODIMENTS:

The following examples are given merely as being illustrative of the present invention and thus are not to be considered as limiting.

EXAMPLE 1

| | Parts by weight |
|---|---|
| Ag (specific surface area, 0.1 $m^2/g$) | 24 |
| $RuO_2$ (specific surface area, 0.1 $m^2/g$) | 36 |
| Glass frit (specific surface area, 2.0 $m^2/g$) | 40 |
| Ethylcellulose | 10 |
| Tetraline | 40 |

The above composition was well milled to make a homogeneous paste which was then printed onto an alumina substrate in an area of 5 mm × 5 mm. After the composition was dried at a temperature of 150° C for 10 minutes, it was gradually heated up to 800° C and maintained at that temperature for 10 minutes. Then the composite was slowly cooled to room temperature. Silver electrodes were formed on the cooled substrate to produce a composite resistor.

EXAMPLES 2–11

With the use of the same components, and utilizing a similar treatment as in Example 1, a series of resistors were obtained according to the composition ratio given in the table shown on page 11.

EXAMPLE 12

| | Parts by weight |
|---|---|
| $RuO_2$ (specific surface area, 4 $m^2/g$) | 25 |
| Glass frit (specific surface area, 0.3 $m^2/g$) | 75 |
| Ethylcellulose | 7 |
| Terpineol | 19 |

The above composition was milled to make a homogeneous paste and was then printed onto an alumina substrate, on which Ag-Pd electrodes (Ag; Pd = 70:30) were previously formed in a desired pattern, in an area of 4 mm × 2 mm. After the composition was dried at a temperature of 150° C for 10 minutes, it was gradually heated up to 760° C and maintained at that temperature for 10 minutes. Then the composition was slowly cooled to room temperature to produce a composite resistor.

EXAMPLES 13–15

With the use of the same components, and utilizing a similar treatment as in Example 12, a series of resistors were obtained according to the composition ratio given in table I.

EXAMPLE 16

| | Parts by weight |
|---|---|
| $RuO_2$ (specific surface area, 10 $m^2/g$) | 10 |
| Glass frit (specific surface area, 0.3 $m^2/g$) | 67 |
| $Al_2O_3$ (specific surface area, 20 $m^2/g$) | 23 |
| Ethyl cellulose | 5.5 |
| Terpineol | 22 |

The above composition was well milled to make a homogeneous paste and was then printed on an alumina substrate, on which Ag-Pd electrodes (Ag:Pd = 70:30) were previously formed in a desired pattern, in an area of 4 mm × 2 mm. After the composition was dried at a temperature of 150° C for 10 minutes, it was gradually heated up to 760° C and maintained at that temperature for 10 minutes. Then the composite was slowly cooled to room temperature to produce a composite resistor.

EXAMPLES 17-21

With the use of the same components and utilizing a similar treatment as in Example 16, a series of resistors were obtained according to the composition ratio given in table I.

EXAMPLE 22

| | Parts by weight |
|---|---|
| $RuO_2$ (specific surface area, 10 $m^2/g$) | 21 |
| Glass frit (specific surface area, 0.3 $m^2/g$) | 74 |
| $SiO_2$ (specific surface area, 265 $m^2/g$) | 5 |
| Ethyl cellulose | 5.5 |
| Terpineol | 22 |

The above composition was well milled to make a homogeneous paste and was then printed on an alumina substrate, on which Ag-Pd electrodes (Ag:Pd = 70:30) were previously formed in a desired pattern, in an area of 4 mm × 2 mm. After the composition was dried at a temperature of 150° C for 10 minutes, it was gradually heated up to 760° C and maintained at that temperature for 10 minutes. Then the composite was slowly cooled to room temperature to produce a composite resistor.

EXAMPLES 23-27

With the use of the same components and utilizing a similar treatment as in Example 22, a series of resistors were obtained according to the composition ratio given in table I.

in ppm/°C unit according to resistance values measured in the range from 25°-125° C.

The weight ratio of the conductor, glass frit and the insulating or semiconductive metal oxide, based on total of 100 parts by weight of either the two or three components, the specific area ($m^2/g$), the resistance (Ω/□), and the TCR (ppm/°C) in each of the examples are shown in the table where the results of the present invention are cleverly shown.

In the table, $W_{Ag}$, $W_{RuO_2}$, $W_{glass}$, $W_{Al_2O_3}$, and $W_{SiO_2}$, represent parts by weight of the Ag, $RuO_2$, glass frit, $Al_2O_3$, and $SiO_2$ and furthermore $S_{Ag}$, $S_{RuO_2}$, $S_{glass}$, $S_{Al_2O_3}$, and $S_{SiO_2}$, represent specific surface area of Ag, $RuO_2$, glass frit, $Al_2O_3$, and $SiO_2$.

As can be seen from the Table, the following conclusions can be readily understood from Examples 1, 4 and 8.

In these Examples, the specific surface areas of Ag, $RuO_2$, and glass frit are maintained constant but the weight ratio of these components are varied: 24, 36, 40; 12, 18, 70; and 8, 12, 80. Such variations in the weight ratio result in resistance values 1Ω, 10kΩ and 100kΩ, and greatly varied TCR, +300, +10, and −100. Variations in resistance values were inevitably accompanied by a considerable variation in TCR. The above phenomena is representative of the prior art. However, in Examples 1, 2 and 3, where the weight ratio is maintained constant, the resistance value varies, only depending upon the variation of the specific surface area, with the TCR being maintained substantially constant.

In these Examples, the resistance value greatly varied from 1Ω/□, 10Ω/□, 80Ω/□, but the TCR varied little from +300 ppm/°C to +290 ppm/°C to +305 ppm/°C.

In the prior art, when the contact area was varied by controlling the weight ratio of the resistive material and the conductive material, the variation in the resistance value was always accompanied by a simultaneous variation deviation in the TCR. With respect to TCR, it should be known that the TCR increases with an increase in the amount of conductive material and decreases with an increase in the amount of glass frit and insulating or semiconductive metal oxide. In previous techniques, the addition of a small amount of semicon-

TABLE I

| Example No. | W | | | | | S | | | | | R | TCR |
|---|---|---|---|---|---|---|---|---|---|---|---|---|
| | $W_{Ag}$ | $W_{RuO_2}$ | $W_{glass}$ | $W_{Al_2O_3}$ | $W_{SiO_2}$ | $S_{Ag}$ | $S_{RuO_2}$ | $S_{glass}$ | $S_{Al_2O_3}$ | $S_{SiO_2}$ | (Ω/□) | (ppm/° C) |
| 1 | 24 | 36 | 40 | — | — | 0.1 | 0.1 | 2.0 | — | — | 1 | +300 |
| 2 | 24 | 36 | 40 | — | — | 0.02 | 0.02 | 2.0 | — | — | 10 | +290 |
| 3 | 24 | 36 | 40 | — | — | 0.1 | 0.1 | 0.05 | — | — | 80 | +305 |
| 4 | 12 | 18 | 70 | — | — | 0.1 | 0.1 | 2.0 | — | — | 10K | +10 |
| 5 | 12 | 18 | 70 | — | — | 0.02 | 0.02 | 2.0 | — | — | 90K | +10 |
| 6 | 12 | 18 | 70 | — | — | 0.1 | 0.1 | 0.05 | — | — | 90K | +9 |
| 7 | 12 | 18 | 70 | — | — | 3.0 | 3.0 | 2.0 | — | — | 1K | +12 |
| 8 | 8 | 12 | 80 | — | — | 0.1 | 0.1 | 2.0 | — | — | 100K | −100 |
| 9 | 8 | 12 | 80 | — | — | 0.02 | 0.02 | 2.0 | — | — | 1M | −100 |
| 10 | 8 | 12 | 80 | — | — | 0.1 | 0.1 | 0.05 | — | — | 10M | −100 |
| 11 | 8 | 12 | 80 | — | — | 3.0 | 3.0 | 2.0 | — | — | 20K | −90 |
| 12 | — | 25 | 75 | — | — | — | 4.0 | 0.3 | — | — | 10K | −50 |
| 13 | — | 25 | 75 | — | — | — | 30. | 0.3 | — | — | 1K | −50 |
| 14 | — | 40 | 60 | — | — | — | 10. | 0.3 | — | — | 500 | +50 |
| 15 | — | 40 | 60 | — | — | — | 30. | 0.3 | — | — | 100 | +50 |
| 16 | — | 10 | 67 | 23 | — | — | 10. | 0.3 | 20. | — | 1M | −100 |
| 17 | — | 10 | 67 | 23 | — | — | 30. | 0.3 | 20. | — | 5K | −100 |
| 18 | — | 40 | 57 | 3 | — | — | 10. | 0.3 | 20. | — | 100 | +50 |
| 19 | — | 40 | 57 | 3 | — | — | 30. | 0.3 | 20. | — | 10 | +50 |
| 20 | — | 25 | 50 | 25 | — | — | 5. | 0.3 | 0.5 | — | 1K | +25 |
| 21 | — | 25 | 50 | 25 | — | — | 5. | 0.3 | 20. | — | 10K | −20 |
| 22 | — | 21 | 74 | — | 5 | — | 5. | 0.3 | — | 265. | 1M | −50 |
| 23 | — | 21 | 74 | — | 5 | — | 5. | 0.3 | — | 3.5 | 100K | −50 |
| 24 | — | 21 | 69 | — | 10 | — | 5. | 0.3 | — | 265. | 500K | −30 |
| 25 | — | 21 | 69 | — | 10 | — | 5. | 0.3 | — | 3.5 | 150K | −60 |
| 26 | — | 45 | 45 | — | 10 | — | 85. | 0.3 | — | 265. | 1K | +100 |
| 27 | — | 45 | 45 | — | 10 | — | 85. | 0.3 | — | 3.5 | 100 | +100 |

Measurement of the specific surface area referred to in the Examples was performed by following the Blaine Permeability Method and the BET Method. The resistance value, R, was obtained by using a conventional Wheatstone bridge apparatus. The TCR is represented ductive metal oxide was employed in order to minimize the deviation of the TCR. However, satisfactory results in reproducibility and stability could not be obtained by following the previous technique and thus the complicated process to obtain a definite resistance could not be avoided.

In the case of our investigations which were aimed at the settlement of the above-mentioned difficulties, it was found that appropriate adjustment of both conductor and resistor components could exhibit desired resistance values depending upon the nature of the components. The above Examples have shown that a wide range of resistance values from Ω to MΩ with low TCR are more easily attained by only modifying and adjusting the specific surface area of the binary or occasionally ternary components. The "resistor composition" in the present invention implies a composite material which produces a firm resistor film on an insulating substrate, by firing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A process for varying the resistance value of a resistor composition containing 10–60 parts by weight of a conductive material selected from the group consisting of gold, silver, platinum, rhodium, ruthenium, osmium, iridium, vanadium, tin, tungsten, carbon and alloys, mixtures and oxides thereof, said conductive material having a known specific surface area, 90–40 parts by weight of a glass frit having a known specific surface area, and a vehicle therefor which comprises increasing or decreasing the total surface area of said conductive material and glass frit while maintaining the weight ratio of said conductive material to said glass frit constant without changing the temperature coefficient of resistance of said composition.

2. The process for varying the resistance value of a resistor composition of claim 1, said resistor composition further containing an insulating or semiconductive metal oxide selected from the group consisting of palladium oxide, copper oxide, aluminum oxide, zinc oxide, iron oxide, chromium oxide, cobalt oxide, tantalum oxide, nickel oxide, niobium oxide, silicon oxide, and mixtures thereof, said conductive material, glass frit, and insulating or semiconductive metal oxide each having known specific surface areas, wherein the total surface area of said conductive material, glass frit and insulating or semiconductive metal oxide is increased or decreased while maintaining the weight ratio of said conductive material, glass frit and insulating or semiconductive metal oxide constant without changing the temperature coefficient of resistance of said composition.

3. The process of claim 2, wherein the specific surface area of the conductive material, glass frit and the insulating or semiconductive metal oxide varies from 0.02 to about 270 $m^2/g$.

4. The process of claim 2, wherein the conductive material, the glass frit and the insulating or semiconductive metal oxide have a diameter of about 100 A to 50 microns.

5. The process of claim 1, wherein the glass frit is selected from the group consisting of borosilicates and lead-borosilicates.

6. The process of claim 1, wherein the conductive material and the glass frit have a diameter of about 100 A to 50 microns.

7. The process of claim 1, wherein the specific surface area of the conductive material and the glass frit varies from 0.02 to about 30 $m^2/g$.

8. The process of claim 1, wherein the specific surface area of one of the components is increased or decreased and the specific surface area of the other component is maintained constant while keeping the weight ratio of said conductive material to said glass frit constant.

9. The process of claim 2, wherein the specific surface area of one or two components is increased or decreased whereas the specific surface area of the residual component or components is maintained constant while keeping the weight ratio of said conductive material, glass frit and insulating or semiconductive metal oxide constant.

* * * * *